United States Patent [19]

Guth et al.

[11] 4,413,998

[45] Nov. 8, 1983

[54] PROCESS FOR THE TREATMENT OF TEXTILE FIBRE MATERIALS

[75] Inventors: Christian Guth, Basel; Jörg Binz, Reinach, both of Switzerland

[73] Assignee: Ciba-Geigy Corporation, Ardsley, N.Y.

[21] Appl. No.: 206,799

[22] Filed: Nov. 14, 1980

Related U.S. Application Data

[63] Continuation of Ser. No. 58,047, Jul. 16, 1979, abandoned.

[30] Foreign Application Priority Data

Jul. 27, 1978 [CH] Switzerland ..... 8084/78

[51] Int. Cl.[3] ..... D06M 13/30; D06P 1/62; B01J 13/00

[52] U.S. Cl. ..... 8/477; 252/8.6; 252/8.8; 252/307; 252/8.7; 252/301.21; 427/389.9; 427/393.2

[58] Field of Search ..... 8/477; 252/8.6, 8.8, 252/307, 8.7, 301.21; 427/389.9, 393.2

[56] References Cited

U.S. PATENT DOCUMENTS

| | | | |
|---|---|---|---|
| 3,533,730 | 10/1970 | Voltz et al. | 8/477 |
| 3,762,860 | 10/1973 | Abrahams et al. | 8/477 |
| 3,785,767 | 1/1974 | Hildebrand et al. | 8/477 |
| 3,953,168 | 4/1976 | Fabbri et al. | 8/477 |
| 3,963,432 | 6/1976 | Hauxwell et al. | 8/477 |
| 3,989,456 | 11/1976 | Vescia et al. | 8/477 |
| 4,030,882 | 6/1977 | Blackwell | 8/477 |
| 4,042,320 | 8/1977 | Becker et al. | 8/477 |
| 4,052,156 | 10/1977 | von der Eltz et al. | 8/477 |
| 4,099,913 | 7/1978 | Walter et al. | 8/477 |
| 4,118,526 | 10/1978 | Gregorian et al. | 8/477 |
| 4,326,904 | 4/1982 | Eckert et al. | 8/477 |

FOREIGN PATENT DOCUMENTS

| | | | |
|---|---|---|---|
| 2080685 | 11/1971 | France . | |
| 2177914 | 3/1973 | France . | |
| 51-38583 | 3/1976 | Japan | 8/477 |
| 1406665 | 9/1975 | United Kingdom . | |
| 1522784 | 8/1978 | United Kingdom . | |

OTHER PUBLICATIONS

Namboodri et al., Amer. Dyestuff Reporter, Jun. 1978, pp. 27–34.

*Primary Examiner*—Maria Parrish Tungol
*Attorney, Agent, or Firm*—Edward McC. Roberts

[57] ABSTRACT

Process for the treatment of textile fibre materials with foams, which contain (a) a first surface-active agent with a HLB value of 0.1 to 10.0, for example a fatty alcohol which can be ethoxylated, and is a major constituent, (b) a second surface-active agent with a HLB value of more than 8.5, as a minor constituent, the HLB value being at least 3.0 units higher than that of component (a), for example an alkali metal or ammonium salt of a fatty acid, of an alkylarylsulfonic acid, of an alkylsulfonic acid, of a sulfuric acid alkyl ester or of a glycol-ether-sulfate, or a fatty acid/alkanolamine reaction product or an ethoxylated fatty alcohol, and (c) a dye, a fluorescent brightener and/or a textile chemical.

17 Claims, No Drawings

PROCESS FOR THE TREATMENT OF TEXTILE FIBRE MATERIALS

This is a continuation of application Ser. No. 58,047 filed on July 16, 1979 now abandoned.

The present invention relates to a process for the treatment of textile fibre materials with the aid of foam, which comprises applying to these fibre materials a foamed, aqueous formulation which has a degree of foaming of 1:6 to 1:20 and which contains at least (a) a first surface-active agent with a HLB value of 0.1 to 10.0 and especially 0.5 to 10.0, as a major constituent, (b) a second surface-active agent with a HLB value of more than 8.5, as a minor constituent, the HLB value being at least 3.0 units higher than that of component (a), (c) a dye, a fluorescent brightener and/or a chemical and (d) if desired, further assistants, and, if desired, drying and fixing.

Foaming components (a) and (b) which are preferably used are a fatty alcohol, which can be ethoxylated, and an alkali metal or ammonium salt of a fatty acid, of an alkylarylsulfonic acid, of an alkylsulfonic acid or of a glycolether-sulfate or of a sulfuric acid alkyl ester, or a fatty acid/alkanolamine reaction product or also an ethoxylated fatty alcohol.

The process according to the invention is suitable for the application of both chemicals and dyes to textile substrates, for example tops, yarn, smooth fabrics, pile fabrics, carpets, knitted fabrics or nonwovens. These substrates include all the conventional natural and synthetic fibre materials, such as cotton, hemp, linen, ramie, regenerated cellulose, cellulose acetate (2½-acetate or triacetate), polyester, polyacrylonitrile, polyamide, wool, silk, polypropylene or mixtures of different fibres, such as polyester/cellulose or polyester/wool mixed fabrics. Fibrous materials containing cellulose and/or polyester, are preferred.

Suitable dyes for dyeing according to the invention, which is to be understood as meaning both the actual dyeing and also printing, are dyes of all the customary categories, for example disperse dyes, reactive dyes, acid dyes, vat dyes, basic dyes, organic pigments or coupling dyes, and also corresponding mixtures of such dyes, which are customary in practice. Examples of dyes are described in the Colour Index, 3rd edition, 1971, volume 4.

Chemicals which can be applied according to the invention are all the chemicals suitable for use in the textile industry, such as finishing agents, protective agents, binders, cleansing agents and sizing agents. Fluorescent brighteners, for example of the styryl or the stilbene series can further be used. For example, antistatic agents, agents which impart hydrophobic properties, flameproofing agents, crease-resistant agents, easy-care agents, stiffeners, anti-soiling agents and soil-release agents can be applied.

Components (a) and (b) of the formulations used according to the invention are the actual foam components. Components (a) and (b) are preferably employed in a weight ratio of (a):(b) of 1.5:1 to 1,000:1, i.e. component (a) as a rule makes up the major proportion of the foam component.

The weight ratio of component (a) and (b) relative to one another is preferably 4:1 to 1,000:1 or especially 8:1 to 400:1.

Component (a) is preferably a surface-active fatty alcohol, which can be ethoxylated and has a HLB value of preferably 0.1 to 10.0 and especially 0.5 to 10.0. Components (a) with HLB values in the range of 0.1 to 7.0 have proved particularly advantageous. The fatty alcohol can be saturated and preferably contains 12 to 22 carbon atoms. Examples of such alcohols are lauryl alcohol, myristyl alcohol, cetyl alcohol, stearyl alcohol, arachyl alcohol or behenyl alcohol or oleyl alcohol. Preferably, the ethoxylated alcohols are employed and a degree of ethoxylation of 0 to 4 and especially 1 to 4 is preferred.

Preferred components (a) are polyethylene glycol 2-cetyl ether or polyethylene glycol stearyl ether or cetyl alcohol.

The HLB value is a measure of the "hydrophiliclipophilic balance" in a molecule. As is known, a molecule of a surfactant is partly hydrophilic and partly lipophilic. The equilibrium between these two parts influences the surface-active properties of the molecule to a decisive extent. It is now possible to quote a number which approximately defines the degree of hydrophilic character and lipophilic character (the HLB value); Molecules which are in the main hydrophilic have higher numbers and molecules which are in the main lipophilic have lower numbers. HLB values can be determined experimentally (W. C. Griffin, JSCC 5, 249 (1954)) or can be calculated (J. T. Davis, Tenside Detergents 11 (1974) No. 3, page 133). It must be assumed that all the HLB values used in this specification are approximate values obtained from experimental determinations or by calculation and can vary slightly with changes in the composition of a specific surfactant.

Component (b) as a rule has a HLB value which is above 8.5 and is at least 3.0 units higher than the HLB value of component (a). In particular, components (b) with a HLB value of 12 to 40 have proved advantageous.

As an alkali metal salt or ammonium salt, component (b) is, for example, a lithium, sodium, potassium, ammonium, monoalkanolamine, diethanolamine, triethanolamine or isopropanolamine salt. Alkali metal salts, such as sodium salts, are, however, preferred.

The fatty acid salts are preferably derived from fatty acids having 10 to 24 carbon atoms, such as capric acid, lauric acid, myristic acid, palmitic acid, stearic acid, arachic acid, behenic acid, lignoceric acid, oleinic acid, linoleic acid, linolenic acid, arachidonic acid or coconut fatty acid. Alkylarylsulfonic acids are as a rule monosulfonic acids of naphthalene or in particular benzene, which are substituted by alkyl having 4 to 18 carbon atoms. In particular, alkylphenolsulfonic acids having 8 to 12 carbon atoms in the alkyl radical are preferred. Alkylsulfonic acids and alkyl sulfates as a rule contain 10 to 24 carbon atoms in the alkyl radical, for example Na lauryl-sulfonate or Na stearyl-sulfonate or, in particular, Na lauryl-sulfate or Na stearyl-sulfate. The glycol-ether-sulfates are as a rule alkanols or alkylphenols having 4 to 12 carbon atoms in the alkyl radical, to which 1 to 10 mols of ethylene oxide have been added on and which have been esterified with sulfuric acid, for example ammonium or sodium nonylphenol-pentaglycol-ether-sulfate. Furthermore, ethoxylated fatty alcohols which have, for example, a degree of ethoxylation of 5 to 100 and especially 8 to 30 and a fatty radical of the type indicates for component (a) are also suitable.

The fatty acid/alkanolamine reaction products are products which are obtained from fatty acids having 10 to 24 carbon atoms, such as those indicated above, and alkanolamines having 2 to 6 carbon atoms, such as ethanolamine, diethanolamine, isopropanolamine or di-isopropanolamine.

Examples of such reaction products are coconut fatty acid diethanolamide and the diethanolamide of lauric acid or stearic acid. In addition to Na lauryl-sulfate, these reaction products are the most preferred.

Depending on the desired effect, the foams to be used according to the invention can also contain further additives, such as acids, alkalis, catalysts, urea, oxidising agents, solvents (for example diethylene glycol monobutyl ether or 2-butoxyethanol) or emulsifiers.

The addition of a thickener is not necessary, since the foams are also stable without thickeners, i.e. have foam half-lives of more than 60 minutes.

The formulations to be applied according to the invention as a rule contain the foaming components (a) and (b) in a concentration of 1 to 100 g/l and especially 10 to 50 g/l.

The procedure employed for producing the foams is preferably first to mix the foaming components (a) and (b) with one another and to dissolve the mixture and thus to obtain aqueous solutions containing 2 to 60 percent by weight of foaming components. Furthermore, it is also possible to melt the components with one another without the addition of water, but in the presence of an organic solvent.

The foams are preferably produced mechanically, by means of high-speed stirrers, mixers or special foam pumps, and using the latter the foams can also be produced continuously. It has proved advantageous to predissolve or pre-disperse the individual components before they are fed into the foaming equipment. If desired, the foams can also be produced with the aid of conventional blowing agents.

According to the invention, degrees of foaming, i.e. the ratios, by volume, of non-foamed to foamed formulation, of 1:6 to 1:20 and preferably 1:8 to 1:15 have proved suitable.

The foams employed according to the invention are distinguished by the fact that they are thick, dense and stable, i.e. can be kept for a prolonged period and, for example, are usable even after a residence time of more than 60 minutes. The consistency can be described as cream-like. The cell diameters in the foams are about 1 to 100$\mu$.

The foams can be applied uniformly to the fibre materials by very diverse application techniques. Some possibilities are for example: drawing in under suction, rolling on, rolling on/suction, doctoring using fixed blades or roller doctors (on one or both sides), padding, blowing in, pressing in, printing, and passing the textile substrate through a chamber which is continuously charged with foam and in which the foam is under a certain pressure. The foam structure is destroyed by the said procedures, the foam being dehydrated and the textile material wetted. Printing processes of primary interest are direct printing, for example planographic printing, rotary printing or roller printing.

As a rule, the foams are applied at room temperature, i.e. about 15° to 30° C. The amount of foam applied is as a rule 20 to 60 and especially 25 to 50 percent by weight, based on the fabric treated.

Fixing of the dyes and chemicals, which is carried out with or without intermediate drying, can be effected, for example, by steaming with saturated steam or superheated steam, by the thermosol method or by means of a chemical bath or a metal bath.

After fixing, washing out, rinsing and drying can be effected in the customary manner.

To enable the absorbing power of the treated fibre materials for the active compounds contained in the stable foams to be increased, it has also proved advantageous to heat the textile substrate. The rate of dehydration of the foam, and thus the wetting and penetration of the substrate treated, are considerably improved by warming the fibre material and, as a result of this, on the one hand the production speed and, on the other hand, the quality of the finish or dyeing are improved in turn. A procedure of this type has proved advantageous in the case of thick pile fabrics in particular.

In a further procedure, especially for dyeing carpets and pile fabrics made of polyamide, wool, polyacrylonitrile, polyesters and others, a dye-containing liquor is foamed and the foam is applied as a foam layer to the pile and dehydrated by means of a vacuum. By this means the dye liquor applied is dispersed from the tips of the pile to the carpet base. A second layer of foam is then applied by means of a doctor blade. The total amount of liquor applied, based on the dry weight of the carpet, is between 75 and 200%, and the second application can amount to between 10 and 50%. Using this process it is also possible to dye polyamide carpet pile material having differentiated affinity for the dye so as to produce a good differentiation effect.

On subsequent steaming (dye fixation), immediate dehydration of the second foam layer takes place, resulting in level and frosting-free dyeing of the pile tips.

The characteristics of the foam produced according to the invention, which collapses immediately during steaming, as a result of dehydration, and does not foam up again, are a prerequisite for carrying out this special process. As a result of these characteristics, level, frosting-free dyeings are obtained.

This process can be carried out on pile materials which have not or have been pre-cleaned (wetting).

The process according to the invention has quite considerable advantages over known processes.

On direct printing, a substantial increase in the rates of fixation for disperse dyes, for example on polyester fabrics, can be observed.

On printing with reactive dyes, the non-fixed portions of dye can be washed out much more easily. Since the absorption of moisture which takes place when working with foams is only slight (up to 40 percent by weight), high drying speeds and short drying times are possible.

Furthermore, only slight migration or even no migration takes place during drying.

Prints have sharp contous. As a result of the small amounts of liquid, there is also only a slight load on the effluent in printing, dyeing and finishing works, and this is valuable from the point of view of ecology. The saving in water is also an advantageous consequence of the present invention. On finishing, an improvement in the relationship between the achievable effect (for example in the case of high-grade finishing) and the losses in strength is also found, compared with that obtained with conventional pad application.

In the examples given below, all the foams have half-lives of more than 60 minutes, percentages are by weight and the dyes have the following formulae:

(1)
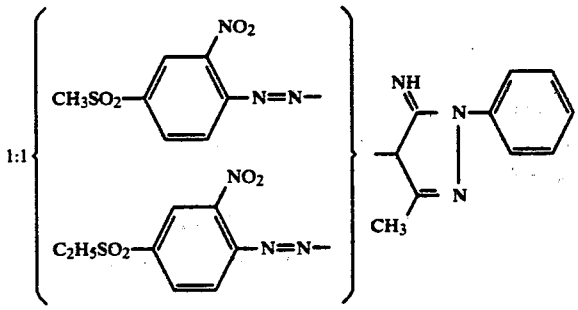
(2)
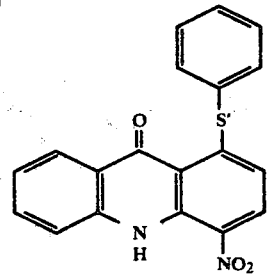
(3)
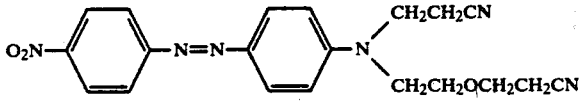
(4)
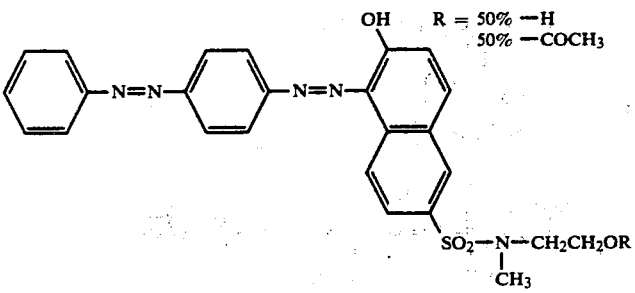
(5)
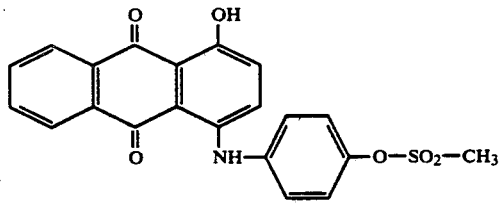
(6)
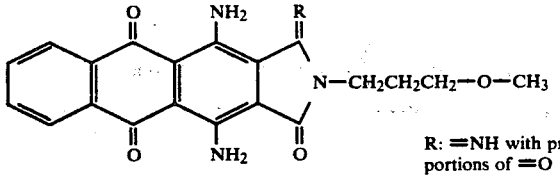
R: =NH with proportions of =O
= Mixture of
(7)
(7.1)
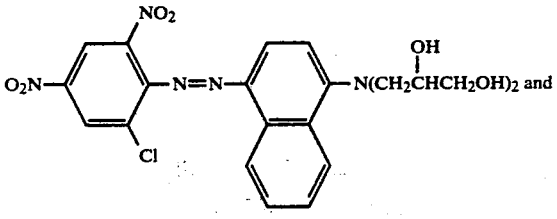
(7.2)
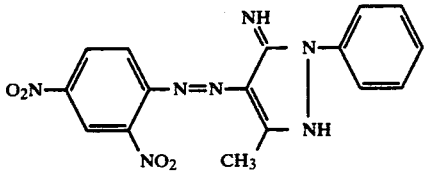
and the dye of the formula (2)
(8)
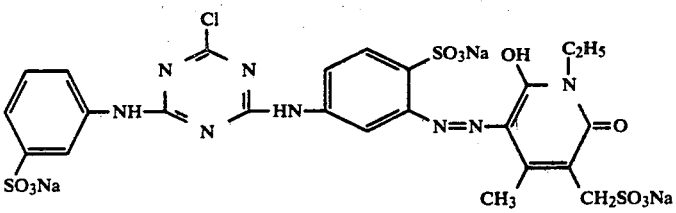
(9)
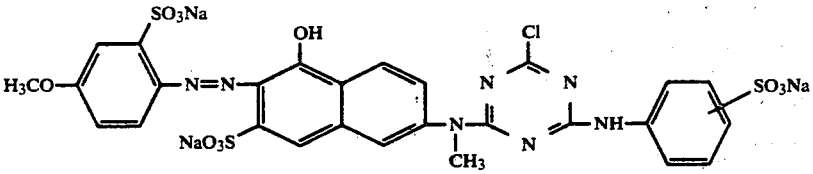

-continued
(10)
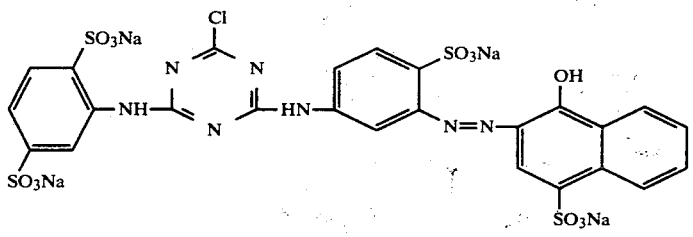
(11)
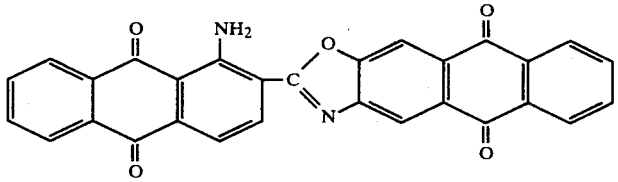
(12)
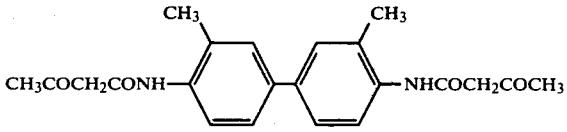
(13)
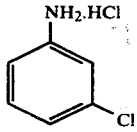
(14)
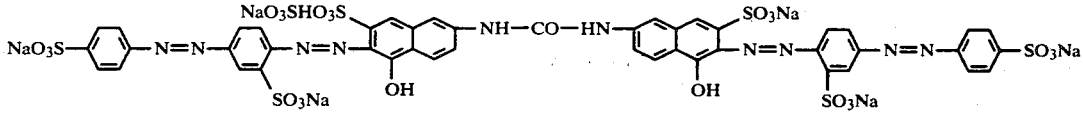
(15)
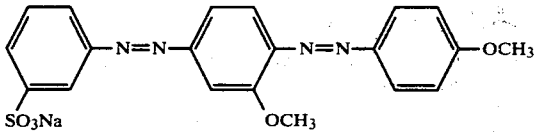
(16)
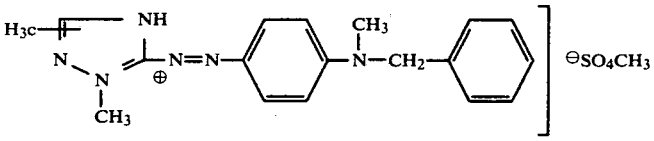
= Mixture of
(17)
(17.1)
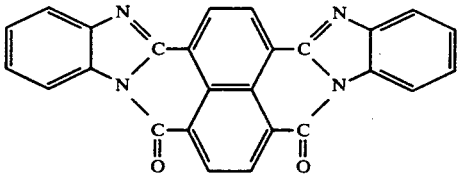
(17.2)
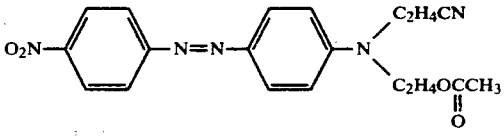
= Mixture of
(18)
(18.1)
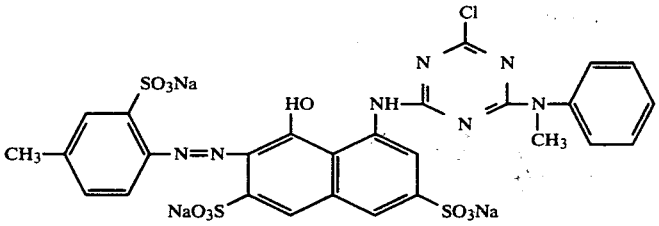

-continued
(18.2.)
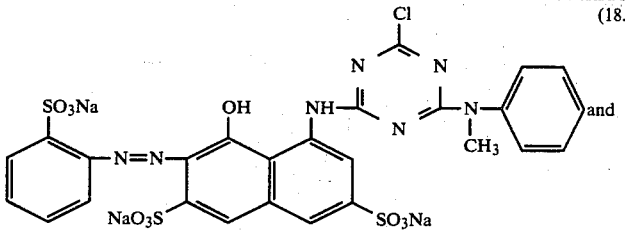
and
(18.3)
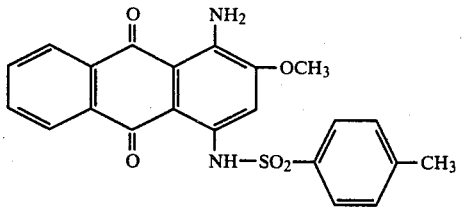
(19)
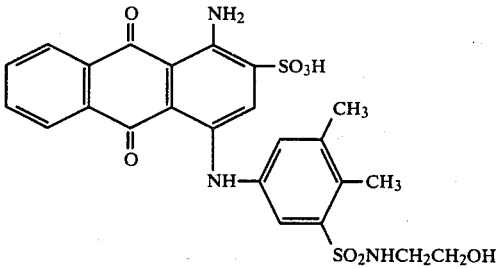
(20)
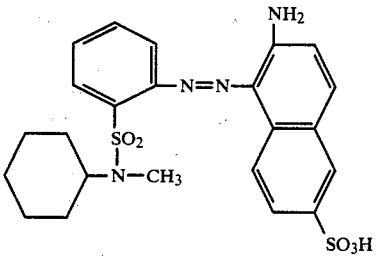
(21)
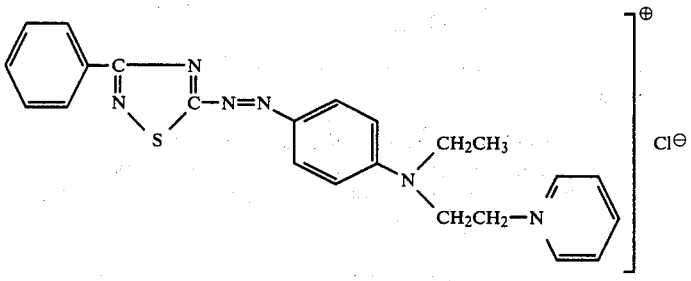
(22)
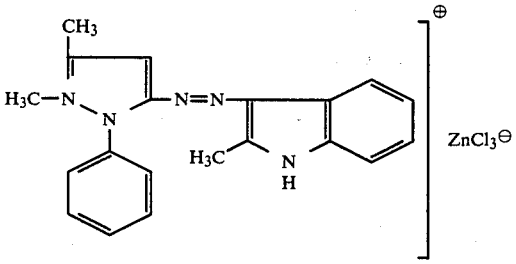
Fluorescent brighteners
(23)
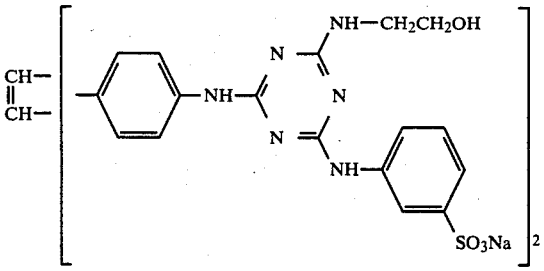
(24)
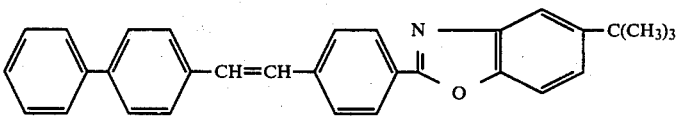
EXAMPLE 1
Composition of a foamable batch:
| | | |
|---|---|---|
| 3 | g | of polyoxyethylene 2-cetyl ether (HLB = 5.3) |
| 0.01 | g | of sodium lauryl-sulfate (HLB value = 40.0) |
| 82.99 | g | of water |
| 14 | g | of dye of one of the formulae (1) to (7) |

-continued

| | |
|---|---|
| 100 g | |

The foam components are warmed with 30 g of water to 75° to 85° C., with stirring, until all the solid constituents have melted. The homogeneous mass is further diluted with the remaining water. After adding the dye, the whole is again mixed thoroughly.

Foaming is effected with a domestic mixer. A fine-pored foam results after a stirring time of 10 minutes. The degree of foaming is 1:8, i.e. 800 ml of foam form from the 100 g bath.

A polyester textured fabric (weight per $m^2$ 170 g) is printed with this "foam paste" by the screen printing process using a roller doctor. The pick-up at the printed points is 35%. The printed fabric is dried and then thermofixed for 90 seconds at 200° C. After thermofixing, it is rinsed thoroughly with cold water and the dye which has not been fixed is removed by reductive cleaning for 10 minutes at 80° C. with a solution containing: 3 ml/l of 30% sodium hydroxide solution and 1 g/l of sodium hydrosulfite.

The degree of fixation of the dyes printed by this process is considerably higher than that achievable by conventional printing with thickeners (carob bean flour).

Calculation of the degree of fixation (%)

$$\frac{\text{Fixed dye} \times 100}{\text{dye employed}}$$

| Dye of the formula | | Degree of fixation in % Foam print | Conventional print* |
|---|---|---|---|
| (1) | 50% | 99 | 78 |
| (2) | 50% | 98 | 80 |
| (3) | 100% | 92 | 70 |
| (4) | 50% | 91 | 59 |
| (5) | 100% | 96 | 74 |
| (6) | 100% | 99 | 72 |
| (7) | 100% | 81 | 66 |

*Print in the same depth of colour

EXAMPLE 2

The procedure is as in Example 1 except that the dye is fixed for 8 minutes at 180° C. using superheated steam.

Degrees of fixation similar to those in Example 1 result.

The procedure of Example 1 is repeated except that the following batches (Examples 3–5) are used. Results similar to those quoted in Example 1 are obtained:

EXAMPLE 3

| | |
|---|---|
| 3 g | of polyoxyethylene 2-stearyl ether (HLB = 4.9) |
| 0.1 g | of lauric acid diethanolamide (HLB = 11.5) |
| 82.9 g | of water |
| 14 g | of a dye of one of the formulae (1) to (7) |
| 100 g | |

EXAMPLE 4

| | |
|---|---|
| 3 g | of polyoxyethylene 2-cetyl ether (HLB = 5.3) |
| 2 g | of coconut fatty acid diethanolamide (HLB = 13.2) |
| 81 g | of water |
| 14 g | of a dye of one of the formulae (1) to (7) |
| 100 g | |

EXAMPLE 5

| | |
|---|---|
| 3 g | of polyoxyethylene 2-$C_{12}/C_{14}$-alcohol ether (HLB = 6.5) |
| 0.01 g | of sodium lauryl-sulfate (HLB = 40) |
| 82.99 g | of water |
| 14 g | of a dye of one of the formulae (1) to (7) |
| 100 g | |

EXAMPLE 6

Batch I of the foam components has the following composition:

| | |
|---|---|
| 300 g | of polyoxyethylene 2-cetyl ether (HLB = 5.3) |
| 50 g | of coconut fatty acid diethanolamide (HLB = 13.2) |
| 300 g | of 2-butoxyethanol |
| 650 g | |

The individual components are melted together at 75° to 85° C. The melt is then allowed to cool, with stirring, and is processed further as the cold material.

The batch suitable for foam printing has the following composition:

| | |
|---|---|
| 6.5 g | of foam component batch I |
| 15 g | of urea |
| 6 g | of sodium carbonate (anhydrous) |
| 4 g | of the dye of the formula (8) |
| 68.5 g | of water |
| 100 g | |

All the components (urea and sodium carbonate pre-dissolved in water) are mixed at room temperature, with vigorous stirring, until a homogeneous emulsion forms. After adding the dye (not pre-dissolved), the mixture is foamed in a mixer; degree of foaming 1:8. A finepored, cream-like, stable foam results. Using this foam, a cotton/poplin fabric is printed by the screen printing process using a roller doctor. The pick-up at the printed points is 32%. The fabric is then steamed with saturated steam for 10 minutes at 102° C. In order to remove the dye which has not been fixed, the print is subjected to thorough cold rinsing and is then washed with boiling water. It is advantageous that the dye which has not been fixed is removed easily. A level print with sharp contours results.

EXAMPLE 7

The dye mixture indicated below is added, in place of the reactive dye, to the batch from Example 6 and the batch is foamed: 8 g of the dye of the formula (4), 50% and 5 g of the dye of the formula (9).

Using this foam, a polyester/cotton fabric (67:33), is printed, as described in Example 6, dried and then subjected to a thermosol treatment for 90 seconds at 200° C. In order to remove the dye which has not been fixed, the fabric is subsequently first rinsed in cold water and then washed in hot water. A sharp print with solid dyeing of both fibres results.

EXAMPLE 8

The following foamable batch is prepard:

| | |
|---|---|
| 3 g | of polyoxyethylene 2-cetyl ether (HLB = 5.3) |
| 0.02 g | of sodium lauryl-sulfate (HLB = 40) |
| 15 g | of a 42% solution of dimethyloldihydroxyethylene-urea |
| 2 g | of $MgCl_2.6H_2O$ |
| 1.4 g | of stearic acid/diethanolamine reaction product (15%) |
| 0.6 g | of a 40% polyethylene emulsion |
| 77.98 g | of water |
| 100 g | |

The foam components are stirred with one third of the water at 75°-85° C. until the mixture is homogeneous, the remaining water and the other components are then added and the whole is again stirred vigorously; degree of foaming 1:8.

Using this foam, a cotton fabric is impregnated on one side using a roller doctor; pick-up 40%. The fabric is then dried and subjected to condensation for 5 minutes at 150° C. The fabric finished in this way has good dimensional stability and good wrinkle-recovery characteristics.

EXAMPLE 9

(a) Preparation of a pasty foam component II:

| | |
|---|---|
| 200 g | of cetyl alcohol (HLB = 0.1) |
| 50 g | of coconut fatty acid diethanolamide (HLB = 13.2) |
| 10.5 g | of an emulsifier obtained from 7 g of an adduct of 15 mols of ethylene oxide with 1 mol of stearyl alcohol and 3.5 g of an adduct of 12 mols of ethylene oxide with 1 mol of stearic acid |
| 739.5 g | of water |
| 1.000 g | |

All the components are mixed to a homogeneous mass at 75°-85° C., with stirring. The mass is then allowed to cool, with stirring.

(b) Foamable batch:

| | |
|---|---|
| 5 g | of foam component batch II |
| 15 g | of a 42% solution of dimethyloldihydroxyethylene-urea |
| 2 g | of $MgCl_2.6H_2O$ |
| 0.1 g | of the fluorescent brightener of the formula (23) |
| 1.4 g | of stearic acid/diethanolamine reaction product (15%) |
| 0.6 g | of a polyethylene emulsion |
| 75.9 g | of water |
| 100 g | |

The components are mixed homogeneously in the cold using a high-speed stirrer and then foamed; degree of foaming 1:8. Using this foam, a cotton/poplin fabric is impregnated on a 2-roll horizontal padder; pick-up 40%. The fabric is then finished as mentioned under Example 8. The finished fabric has very good creasefree effects and has the same white effect on both sides.

EXAMPLE 10

Bath III of the foam component has the following composition:

| | |
|---|---|
| 500 g | of polyethylene glycol 2-cetyl ether (HLB 5.3) |

-continued

| | |
|---|---|
| 1.67 g | of sodium lauryl-sulfate (HLB 40) |
| 498.33 g | of water |
| 1,000 g | |

The impregnating liquor to be foamed has the following composition: 60 g/l of the dye of the formula (10). 5 g/l of the Na salt of 3-nitrophenylsulfonic acid and 40 g/l of foam component batch III.

All the components are pre-dissolved and foamed in a mixer; degree of foaming 1:12. Using the fine-pored, stable foam, a cotton/calico fabric is impregnated on a 2-roll horizontal padder, the liquor pick-up being 35%. After drying at 80°-90° C., the fabric is impregnated with the following solution at room temperature: 250 g/l of $Na_2SO_4.10H_2O$ and 40 ml/l of 30% sodium hydroxide solution, and is then steamed for 60 seconds with saturated steam at 102°-103° C. The fabric is subjected to thorough cold and hot rinsing and is then soaped at the boil with 1 g/l of an adduct of 9 mols of ethylene oxide with 1 mol of p-nonylphenol. A level dyeing with excellent fastness properties results.

EXAMPLE 11

Batch IV of the foam components has the following composition:

| | |
|---|---|
| 461.5 g | of polyoxyethylene 2-cetyl ether (HLB = 5.3) |
| 77.0 g | of coconut fatty acid diethanolamide (HLB = 13.2) |
| 461.5 g | of 2-butoxyethanol |
| 1,000 g | |

The impregnating liquor to be foamed has the following composition: 60 g/l of the dye of the formula (10), 5 g/l of the Na salt of 3-nitrophenylsulfonic acid, 200 g/l of urea, 40 g/l of sodium carbonate (anhydrous) and 65 g/l of foam component batch IV.

All the components are pre-dissolved and foamed 1:15 using a mixer. A cotton/calico fabric is impregnated on a 2-roll padder with a liquor pick-up of 35% and is then dried at 80°-90° C. In order to fix the dye, thermofixing is carried out for 5 minutes at 150° C. The fabric is then rinsed and soaped as described in Example 10. A flawless dyeing results.

EXAMPLE 12

Batch V of the foam components has the following composition:

| | |
|---|---|
| 200 g | of cetyl alcohol (HLB = 0.1) |
| 50 g | of coconut fatty acid diethanolamide (HLB = 13.2) |
| 10.5 g | of an emulsifier obtained from 7 g of an adduct of 15 mols of ethylene oxide with 1 mol of stearyl alcohol and 3.5 g of an adduct of 12 mols of ethylene oxide with 1 mol of stearic acid |
| 739.5 g | of water |
| 1,000 g | |

The impregnating liquor to be foamed has the following composition: 100 g/l of the dye of the formula (11), 50 g/l of foam component batch V and 1 ml/l of 40% acetic acid.

All the components are pre-dissolved and foamed 1:12 in a mixer. A cotton/calico fabric is impregnated on a 2-roll padder with a liquor pick-up of 35% and is then dried at 80°-90° C. The fabric is then padded with:

80 ml/l of 30% sodium hydroxide solution, 45 g/l of sodium hydrosulfite and 35 g/l of $Na_2SO_4.10H_2O$. Liquor pick-up: 80%.

The fabric is then steamed for 45 seconds in saturated steam at 102° C. After thorough cold rinsing, oxidation is carried out for 15 minutes at 30° C. with 2 ml/l of 30% $H_2O_2$ and soaping is then carried out for 20 minutes at 98° C. with 2 g/l of the di-Na salt of 1-benzyl-2-heptadecyl-benzimidazole-disulfonic acid. After thorough hot and cold rinsing, the fabric is dried. A level red dyeing with very good fastness properties is obtained.

EXAMPLE 13

The impregnating liquor has the following composition: 30 g/l of the dye of the formula (12), 30 g/l of ethanol, 30 g/l of 30% sodium hydroxide solution, 50 g/l of $Na_2SO_4.10H_2O$ and 50 g/l of foam component batch IV.

All the components are pre-dissolved and foamed 1:7 in a mixer. A cotton/satin fabric is impregnated on a 2-roll padder with a liquor pick-up of 35% and is then dried at 70° C.

The fabric is then padded with: 20 g/l of the dye of the formula (13) and 40 g/l of NaCl, using a liquor pick-up of 75%, and the fabric is then allowed to remain exposed to the air for 10 minutes. In order to finish the dyeing, soaping is then carried out for 10 minutes at the boil with 2 g/l of the adduct of 9 mols of ethylene oxide with 1 mol of p-nonylphenol and 3 g/l of sodium carbonate (anhydrous). A brilliant yellow dyeing is obtained.

EXAMPLE 14

30 g/l of Cu phthalocyanine, 100 g/l of a 43% emulsion of a copolymer of 29% of n-butyl acrylate, 8% of 2-ethylhexyl acrylate, 4% of acrylonitrile, 1% of acrylamide and 1% of N-methylolacrylamide. 40 g/l of foam component batch III, 100 g/l of a resin solution containing 30% of dimethyloldihydroxyethyleneurea, 13% of pentamethylolmelamine tetramethyl ether and 27% of a urea/isobutyraldehyde/formaldehyde/methanol reaction product and 3 g/l of $MgCl_2.6H_2O$.

All the components are pre-dissolved and foamed 1:12 in a mixer. A cotton fabric and a 50/50 polyester/cotton mixed fabric are each impregnated on a 2-roll padder. The liquor pick-up is 35% and 30% respectively. The fabrics are then dried at 80°-90° C. and subjected to thermofixing at 180° C. for 30 seconds. A good dyeing results on both fabrics.

EXAMPLE 15

40 g/l of the dye of the formula (14), 100 g/l of urea, 50 g/l of thiodiglycol and 50 g/l of foam component batch III.

All the components are pre-dissolved and foamed 1:8 in a mixer. A rayon staple/serge fabric is impregnated on a 2-roll horizontal padder with a liquor pick-up of 40% and is then steamed without intermediate drying, for 5 minutes at 102°-103° C. in saturated steam. After rinsing in cold water, the fabric is subjected to an after-treatment for 20 minutes at 40° C. in a bath containing 2% of a formaldehyde/ethylenediamine dihydrochloride reaction product, based on the weight of fibre, and 1 ml/l of 80% acetic acid. A solid dyeing with good fastness properties is obtained.

EXAMPLE 16

16 a fabric: triacetate 16 b fabric: 2½-acetate

Composition of the printing paste: 70 g/l of the dye of the formula (3), 5 g/l of tartaric acid and 40 g/l of foam component batch III.

All the components are pre-dissolved and foamed 1:12 in a mixer. Using this foam paste, a triacetate fabric and a 2½-acetate fabric are printed by the screen-printing process using a roller doctor and dried at 80°-90° C.

The procedure for fixing is as follows:

Triacetate fabric: 8 minutes high-temperature steaming at 180° C. in a festoon steamer.

2½-acetate fabric: steam for 30 minutes at 102°-103° C. with saturated steam.

After-treatment of the prints:

Triacetate fabric: rinse cold and then clean reductively with: 2 ml/l of 30% sodium hydroxide solution, 2 g/l of Na hydrosulfite and 1 g/l of a 30% solution of an adduct of 17 mols of ethylene oxide with stearylethylenetriamine, for 10 minutes at 60° C. and rinse hot and cold.

2½-acetate fabric: rinse cold, then soap for 15 minutes at 40° C. with: 1 g/l of a 30% solution of an adduct of 17 mols of ethylene oxide with stearylethylenetriamine, and rinse cold.

EXAMPLE 17

40 g/l of the dye of the formula (15), x g/l of 40% acetic acid (pH 5) and 30 g/l of foam component batch III.

All the components are pre-dissolved and foamed 1:12 in a mixer. A polyamide-6,6 fabric is impregnated on a 2-roll padder with a liquor pick-up of 35%. It is then steamed, without intermediate drying, for 10 minutes at 102°-103° C. in saturated steam. After thorough cold rinsing, it is subjected to the following after-treatment in order to improve the wet fastness properties: 2 g/l of a 2:1 mixture of dioxydiphenylsulfone/p-phenolsulfonic acid for 10 minutes at 20°-30° C.

EXAMPLE 18

40 g/l of the dye of the formula (16), 15 g/l of tartaric acid, 0.6 g/l of a naphthalenesulfonic acid/formaldehyde condensation product, 0.7 g/l of sodium chlorate and 65 g/l of foam component batch IV.

All the components are pre-dissolved and foamed 1:12 in a mixer. A polyacrylonitrile fabric is impregnated on a 2-roll horizontal padder with a liquor pickup of 35% and dried at 80°-90° C. It is then steamed for 30 minutes in saturated steam at 102°-103° C. After thorough rinsing with cold water, the fabric is soaped at 50° C. with 2 g/l of a coconut fatty acid/diethanolamine reaction product and then rinsed, warm and cold. A level red dyeing with good fastness properties results.

EXAMPLE 19

40 g/l of the dye of the formula (15), 10 ml/l of acetic acid and 30 g/l of foam component batch III.

All the components are pre-dissolved and foamed 1:12 in a mixer. Wool tops are impregnated on a 2-roll horizontal padder with a liquor pick-up of 35%.

The tops are then steamed, without intermediate drying, for 30 minutes in saturated steam at 102° C. and then rinsed warm. A good yellow dyeing results.

EXAMPLE 20

70 g/l of the dye of the formula (17.1) and (17.2), 40 g/l of foam component batch III and 1 ml/l of 40% acetic acid.

All the components are pre-dissolved and foamed 1:10 in a mixer. A 50/50 polyester/cotton mixed fabric is impregnated on a 2-roll padder with a liquor pick-up of 35% and dried at 80°–90° C. The fabric is then subjected to a thermosol treatment at 210° C. for 60 seconds and is then padded with: 80 ml/l of 30% sodium hydroxide solution, 45 g/l of Na hydrosulfite and 35 g/l of $Na_2SO_4.10H_2O$. Liquor pick-up: 70%.

Without intermediate drying, the fabric is steamed with saturated steam at 102°–103° C. for 45 seconds. After thorough cold and hot rinsing, oxidation is carried out at 30° C. for 15 minutes with 2 ml/l of 30% $H_2O_2$ and soaping is then carried out for 20 minutes at 98° C. with 2 g/l of the di-Na salt of 1-benzyl-2-heptadecyl-benzimidazole-disulfonic acid.

EXAMPLE 21

80 g/l of the dye of the formulae (18.1), (18.2) and (18.3), 200 g/l of urea, 40 g/l of $Na_2CO_3$ (anhydrous) and 65 g/l of foam component batch IV.

All the components are pre-dissolved and foamed 1:12 in a mixer. A 50/50 polyester/cotton mixed fabric is impregnated, with a liquor pick-up of 35%, on a 2-roll padder and dried at 80°–90° C. It is then subjected to a thermosol treatment for 30 seconds at 200° C. After thorough rinsing with cold and hot water, the fabric is soaped at the boil with 2 g/l of an adduct of 9 mols of ethylene oxide with 1 mol of p-nonylphenol and rinsed hot and cold. A dyeing results in which there is solid dyeing of both fibre constituents.

EXAMPLE 22

A stable impregnating foam is prepared as indicated in Example 1:

| | |
|---|---|
| 3 g | of polyoxyethylene 2-cetyl ether (HLB = 5.3) |
| 1 g | of polyoxyethylene-(12) stearyl ether (HLB = 15.3) |
| 6 g | of the dye of the formula (6) |
| 90 g | of water |
| 100 g | |

The foam is applied to a polyester fabric in the manner indicated in Example 1. A blue print with a high degree of fixation of the dye is obtained.

EXAMPLE 23

The following dye liquor is foamed: 10 g/l of the dye of the formula (19), 1 g/l of Na acetate, 30 g/l of polyoxyethylene 2-cetyl ether (HLB=5.3), 0.1 g/l of Na lauryl-sulfate (HLB=40) and x ml/l of acetic acid (to pH 6). Degree of foaming 1:11.

This foam is applied in the form of a foam layer by means of a doctor to a polyamide-6 carpet (velour with polypropylene tape base). The thickness of the foam carpet corresponds to a liquor application of 130%. The foam is then dehydrated by applying a vacuum of about 0.1 bar to the underside of the carpet and the liquor is dispersed in the carpet pile. A second foam layer is then applied, which corresponds to a liquor pick-up of 30%. Without intermediate drying, steaming is then carried out for 5 minutes with saturated steam at 98°–100° C., and the dyed carpet is then rinsed in cold water. A frosting-free, level dyeing with good fastness properties results.

EXAMPLE 24

The following foamable batches are prepared and foamed in the same way as indicated in Example 1, the foam half-life being more than 60 minutes in each case:

24.1

20 g/l of a 26% aqueous solution of a reaction product of the formula

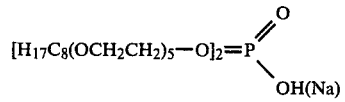

40 g/l of stearyl alcohol (HLB=0.1) and 10 g/l of the Na salt of lauric acid (HLB=21). Degree of foaming 1:9.

24.2

250 g/l of a 50% solution of a 1:1 mixture of dimethylolurea and 1,3-dimethylol-4-methoxy-5,5-dimethylpropyleneurea, 50 g/l of a 15% aqueous solution of a reaction product of 1 mol of stearic acid and 2 mols of diethanolamine, 35 g/l of $MgCl_2.6H_2O$, 20 g/l of cetyl alcohol (HLB 0.1) and 4 g/l of polyoxyethylene-(20) lauryl ether (HLB 17). Degree of foaming 1:12.

24.3

100 g/l of an agent for imparting hydrophobic properties, which is based on paraffin and a fatty acid/N-methylolmelamine methyl ether reaction product modified with an alkanolamine, 80 g/l of a 60% aqueous solution of pentamethylolmelamine 2½-methyl ether, 5 g/l of $AlCl_3.6H_2O$, 30 g/l of oleyl alcohol (HLB=0.1) and 7 g/l of polyoxyethylene-(30) oleyl ether (HLB=15.3). Degree of foaming 1:15.

24.4

120 g/l of a 60% aqueous solution of pentamethylolmelamine 2½-methyl ether, 500 g/l of 3-(dimethyl-phosphono-) propionic acid-N-methylolamide (80%). 60 g/l of 2-amino-2-methyl-propan-1-ol, 6 g/l of polyoxyethylene 2-cetyl ether (HLB=5.3) and 1.5 g/l of coconut fatty acid diethanolamide (HLB=13). Degree of foaming 1:8.

24.5

500 g/l of a 45% aqueous solution of a dimethylolurea/monoethanolamine reaction product. 60 g/l of a 50% aqueous solution of a methylated melamine/ethyleneurea/formaldehyde reaction product, 20 g/l of a 24% aqueous emulsion of a N-methylolmelamine modified with fatty acid, 40 g/l of 2-amino-2-methyl-propan-1-ol, 15 g/l of polyoxyethylene 2-stearyl ether (HLB=4.9) and 3 g/l of the Na salt of oleic acid (HLB=18). Degree of foaming 1:10.

24.6

50 g/l of a 15% aqueous solution of a reaction product of bisphenol A, epichlorohydrin and diethylenetriamine, 50 g/l of a 40% silicone oil emulsion, 10 g/l of a 60% aqueous solution of pentamethylolmelamine 2½-methyl ether, 6 g/l of $ZnCl_2.6H_2O$, 10 g/l of polyoxyethylene 2-cetyl ether (HLB=5.3) and 2 g/l of coconut fatty acid diethanolamide (HLB=13.2). Degree of foaming 1:10.

24.7

120 g/l of a 50% solution of a 1:1 mixture of dimethylolurea and 1,3-dimethylol-4-methoxy-5,5-dimethylpropyleneurea, 30 g/l of a 40% aqueous polyethylene emulsion, 5 g/l of the fluorescent brightener of the formula (24) (20%), 20 g/l of $MgCl_2.6H_2O$, 40 g/l of myristyl alcohol (HLB=0.1) and 10 g/l of polyoxyethylene-(20) lauryl ether (HLB=17). Degree of foaming 1:13.

24.8

100 g/l of a 75% aqueous solution of dimethylolglyoxalmonourein, 50 g/l of a 26% aqueous dispersion of a condensation product of hexamethylolmelamine pentamethyl ether and stearic acid methylolamide isobutyl ether, 50 g/l of a 20% solution of a fluorine chemical based on a perfluoroalkylsulfonamide, 5 g/l of acetic acid (40%), 20 g/l of polyoxyethylene 2-cetyl ether (HLB=5.3) and 5 g/l of coconut fatty acid diethanolamide (HLB=13.2). Degree of foaming 1:9.

24.9

250 g/l of a 60% solution of pentamethylolmelamine 2½-methyl ether, 10 g/l of polyvinyl alcohol, 40 g/l of 2-amino-2-methyl-propan-1-ol, 24 g/l of polyoxyethylene 2-cetyl ether (HLB=5.3) and 6 g/l of the Na salt of palmitic acid (HLB=19). Degree of foaming 1:11.

24.10

50 g/l of a 75% solution of dimethylglyoxalmonourein, 30 g/l of an aqueous polyethylene emulsion, 30 g/l of 2-amino-2-methyl-propan-1-ol, 30 g/l of polyoxyethylene 2-stearyl ether (HLB=4.9) and 5 g/l of a 40% solution of the $NH_4$ salt of an acid sulfuric acid ester of the adduct of 2 mols of ethylene oxide with 1 mol of p-nonylphenol (HLB=16). Degree of foaming 1:8.

24.11

100 g/l of a 20% aqueous emulsion of a copolymer of acrylic acid methoxypolyethylene glycol ester, acrylic acid and N-methylolacrylamide, 3 g/l of $NH_4Cl$, 7 g/l of phosphoric acid, 15 g/l of polyoxyethylene 2-cetyl ether (HLB=5.3) and 3 g/l of coconut fatty acid diethanolamide (HLB=13). Degree of foaming 1:12.

24.12

20 g/l of a 24% aqueous emulsion of a N-methylolmelamine modified with fatty acid, 400 g/l of a 42% aqueous solution of a urea/glyoxal/formaldehyde reaction product, 30 g/l of sulfuric acid (98%), 16 g/l of polyoxyethylene 2-stearyl ether (HLB=4.9) and 4 g/l of coconut fatty acid diethanolamide (HLB=13). Degree of foaming 1:9.

The data relating to the fabric, the application, the procedure and the effect achieved for foam preparations 24.1 to 24.12 are listed in Table I below.

TABLE I

| Example | Material | Foam application in % | Process | Effect |
|---|---|---|---|---|
| 24.1a | polyacrylonitrile fabric | 49% | Roller doctor, drying at 70° C. | Antistatic |
| 24.1b | Polyester fabric | 36% | Roller doctor, drying at 70° C. | Antistatic |
| 24.2 | Cotton/twill | 35% | Roller doctor, drying, thermofixing for 4 minutes at 155° C. | Easy-care finish, fast to chlorine wash |
| 24.3a | Cotton/poplin | 44% | Roller doctor, drying, thermofixing for 4 minutes at 155° C. | Rendered hydrophobic |
| 24.3b | Cotton/polyester 33:67 | 35% | Roller doctor, drying, thermofixing for 4 minutes at 160° C. | Rendered hydrophobic |
| 24.4 | Cotton/twill | 40% | Padding, drying, thermofixing for 5 minutes at 155° C. | Flameproof finish |
| 24.5 | Rayon staple fabric | 46% | Padding, drying, thermofixing for 3 minutes at 160° C. | Imitation linen |
| 24.6 | Polyacrylonitrile tricot | 30% | Roller doctor, drying, thermofixing for 30 seconds at 170° C. | Crease-resistant, dimensionally stable, full, soft handle |
| 24.7 | Cotton/polyester 50:50 | 50% | Roller doctor, drying, thermofixing for 5 minutes at 150° C. | Easy-care finish |
| 24.8 | Cotton/polyester 33:67 | 28% | Roller doctor, drying, thermofixing for 5 minutes at 155° C. | Easy-care and soil release |
| 24.9 | Polyester fabric | 27% | Padding, drying, thermofixing for 40 seconds at 210° C. | Stiffening finish |
| 24.10 | Cotton/poplin | 35% | Roller doctor, drying, thermofixing for 5 minutes at 140° C. | Easy-care finish |
| 24.11 | Textured polyester | 40% | Roller doctor, drying, thermofixing for 30 seconds at 130° C. | Hydrophilic, antistatic, stain-repellent |
| 24.12 | Cotton/poplin | 37% | Roller doctor, damp crosslinking for 20 hours, 20 hours at 25° C. | Easy-care finish |

EXAMPLE 25

Dyeing of "differential dyeing" polyamide carpet material: 2.5 g/l of the dye of the formula (15), 0.38 g/l of the dye of the formula (20), 2.8 g/l of the dye of the formula (19), 30 g/l of polyoxyethylene 2-cetyl ether (HLB=5.3), 0.1 g/l of Na lauryl-sulfate (HLB=40), 1 g/l of Na acetate and x ml/l of acetic acid (to pH 5.5). Degree of foaming 1:10.

This foam is applied in the form of a foam layer by means of a doctor to a carpet (polyamide-6, loop goods with basic, "low" and "deep" dyeing types), corresponding to a liquor application of 100%. The foam is then dehydrated by applying a vacuum of 0.02 bar and the liquor is dispersed in the carpet pile. A second foam layer is then applied, which corresponds to a liquor pick-up of 20%. Without intermediate drying, steaming is then carried out for 5 minutes with saturated steam at 98°-100° C. and the carpet is then rinsed in cold water. A frosting-free, level, green carpet piece-dyeing with good differentiation and good fastness properties results.

EXAMPLE 26

Dyeing of "differential dyeing" polyamide carpet material: 2.5 g/l of the dye of the formula (15), 0.38 g/l of the dye of the formula (20), 2.8 g/l of the dye of the formula (19), 0.47 g/l of the dye of the formula (22), 0.16 g/l of the dye of the formula (21), 30 g/l of polyoxyethylene 2-cetyl ether (HLB=5.3), 0.1 g/l of Na lauryl-sulfate (HLB=40), 1 g/l of Na acetate and x ml/l of acetic acid (to pH 5.5). Degree of foaming: 1:10.

The procedure is the same as that indicated in Example 25. A level, frosting-free, yellow-green carpet piece-dyeing with good differentiation and good fastness properties results.

What is claimed is:

1. A foamed, aqueous composition which has a degree of foaming of 1:6 to 1:20, a foam half-life of more than 60 minutes and which contains at least (a) a first surface-active agent as a major constituent, having an HLB-value of 0.1 to 10.0, and being a fatty alcohol of 12 to 24 carbon atoms or an ethylene-oxide adduct of said fatty alcohol containing 1 to 4 oxyethylene groups, (b) a second surface-active agent as a minor constituent, having an HLB-value of more than 8.5 and at least 3.0 units higher than that of component (a), and being an alkali metal or ammonium salt of a fatty acid having 10 to 24 carbon atoms, of an alkylphenyl- or alkylnaphthalene-sulfonic acid having 4 to 18 carbon atoms in the alkyl radical, of an alkylsulfonic acid having 10 to 24 carbon atoms in the alkyl radical, of a sulfuric acid alkyl ester having 10 to 24 carbon atoms, or of a sulfuric acid ester of an alkanol/ethylene oxide or alkylphenol/ethylene oxide adduct having in each case 4 to 12 carbon atoms in the alkyl radical and a degree of ethoxylation of 1 to 10, or a reaction product of a fatty acid having 10 to 24 carbon atoms with an alkanolamine having 2 to 6 carbon atoms, and (C) a dye, or a fluorescent brightener or a textile chemical, wherein the weight ratio of (a):(b) is 4:1 to 1000:1.

2. A process for the treatment of textile fibers with the aid of foam, comprising the steps of:

(1) applying to the fibers a foamed, aqueous formulation which has a degree of foaming of 1:6 to 1:20, a foam half-life of more than 60 minutes and which contains at least (a) a first surface-active agent as a major constituent, having an HLB-value of 0.1 to 10.0, and being a fatty alcohol of 12 to 24 carbon atoms or an ethylene-oxide adduct of said fatty alcohol containing 1 to 4 oxyethylene groups, (b) a second surface-active agent, as a minor constituent, having an HLB-value of more than 8.5 and at least 3.0 units higher than that of component (a), and being an alkali metal or ammonium salt of a fatty acid having 10 to 24 carbon atoms, of an alkylphenyl- or alkylnaphthalene-sulfonic acid having 4 to 18 carbon atoms in the alkyl radical, of an alkylsulfonic acid having 10 to 24 carbon atoms in the alkyl radical, of a sulfuric acid alkyl ester having 10 to 24 carbon atoms or, of a sulfuric acid ester of an alkanol/ethylene oxide or alkylphenol/ethylene oxide adduct having in each case 4 to 12 carbon atoms in the alkyl radical and a degree of ethoxylation of 1 to 10, or a reaction product of a fatty acid having 10 to 24 carbon atoms with an alkanolamine having 2 to 6 carbon atoms, and (c) a dye, or a fluorescent brightener or a textile chemical, wherein the weight ratio of (a):(b) is 4:1 to 1000:1; and (2) fixing the treated fibers with or without intermediate drying.

3. A process according to claim 2, wherein the degree of foaming is 1:8 to 1:15.

4. A process according to claim 2, wherein the foamed formulation is free from thickeners.

5. A process according to claim 2, wherein the treatment of the fibers is carried out continuously.

6. A process according to claim 2, wherein the foam is produced by mechanical foaming.

7. A process according to claim 2, wherein the foamed, aqueous formulation is applied to the fibre material by printing, padding or doctoring.

8. A process according to claim 2, wherein the fibers are a sheet-like structure.

9. A process according to claim 2, wherein the foamed formulation is applied to warmed textile fibers.

10. A process according to claim 2, wherein the weight ratio of (a):(b) is 8:1 to 400:1.

11. A process according to claim 2 wherein component (a) is polyethylene glycol (2)-cetyl ether, polyethylene glycol (2)-stearyl ether or cetyl alcohol and component (b) is sodium laurylsulfate, coconut fatty acid diethanolamide, stearic acid diethanolamide or lauric acid diethanolamide.

12. A process according to claim 2, wherein the HLB value of component (a) is 0.5 to 10.0.

13. A process according to claim 2, wherein the HLB value of component (a) is 0.1 to 7.0.

14. A process according to claim 2, wherein the HLB value of component (b) is 12 to 40.

15. A process according to claim 2, wherein a first foam layer is applied to the pile side of a carpet and drawn in by means of a vacuum, a second foam layer is then applied and the foam is dehydrated by steaming and component (c) is fixed.

16. A process according to claim 2, wherein the carpet is dyed.

17. A process according to claim 2, wherein the second foam layer does not foam up on steaming.

* * * * *